US006725936B2

(12) United States Patent
Hopper

(10) Patent No.: US 6,725,936 B2
(45) Date of Patent: Apr. 27, 2004

(54) METHOD FOR DRILLING A PLURALITY OF OFFSHORE UNDERWATER WELLS

(75) Inventor: Hans Paul Hopper, Whiterashes (GB)

(73) Assignee: Cooper Cameron Corporation, Houston, TX (US)

( * ) Notice: Subject to any disclaimer, the term of this patent is extended or adjusted under 35 U.S.C. 154(b) by 0 days.

(21) Appl. No.: 10/281,853

(22) Filed: Oct. 28, 2002

(65) Prior Publication Data

US 2003/0051880 A1 Mar. 20, 2003

Related U.S. Application Data

(62) Division of application No. 09/275,748, filed on Mar. 24, 1999, now Pat. No. 6,497,286.

(30) Foreign Application Priority Data

Mar. 27, 1998 (EP) ..... 98302374

(51) Int. Cl.[7] ..... E21B 43/01; E21B 43/017; E21B 33/035

(52) U.S. Cl. ..... 166/366; 166/368; 166/358; 166/351; 175/7

(58) Field of Search ..... 175/5, 7, 10; 166/335, 166/351, 368, 366, 358, 338

(56) References Cited

U.S. PATENT DOCUMENTS

| | | | | |
|---|---|---|---|---|
| 3,392,734 A | | 7/1968 | Townsend, Jr. et al. | |
| 3,732,923 A | | 5/1973 | Fowler | 166/6 |
| 3,764,176 A | | 10/1973 | Soulié et al. | 294/86.25 |
| 3,885,623 A | | 5/1975 | Watkins et al. | 166/0.5 |
| 4,030,310 A | | 6/1977 | Schirtzinger | 61/86 |
| 4,063,602 A | * | 12/1977 | Howell et al. | 175/7 |
| 4,068,729 A | | 1/1978 | Peevy | 175/8 |
| 4,077,472 A | * | 3/1978 | Gano | 166/382 |
| 4,223,737 A | * | 9/1980 | O'Reilly | 166/336 |
| 4,326,595 A | | 4/1982 | Burns | 175/9 |
| 4,407,364 A | | 10/1983 | Johnston | 166/217 |
| 4,462,717 A | | 7/1984 | Falcimaigne | 405/195 |
| 4,695,189 A | | 9/1987 | Wallace | 405/169 |
| RE32,623 E | | 3/1988 | Marshall et al. | 175/9 |
| 4,730,677 A | | 3/1988 | Pearce et al. | 166/345 |
| 4,754,817 A | | 7/1988 | Goldsmith | 175/7 |
| 4,874,008 A | | 10/1989 | Lawson | 137/315 |
| 5,129,459 A | | 7/1992 | Breese et al. | 166/399 |
| 5,518,340 A | | 5/1996 | Hall et al. | 405/458 |
| 5,697,447 A | | 12/1997 | Børseth | 166/366 |
| 5,702,205 A | | 12/1997 | Mahone et al. | 405/169 |

FOREIGN PATENT DOCUMENTS

| | | | |
|---|---|---|---|
| GB | 2 151 288 | 7/1985 | E02D/25/00 |
| GB | 2 183 274 | 1/1987 | E21B/21/00 |
| GB | 2 148 842 | 6/1995 | B67D/5/68 |
| GB | 2 307 929 | 6/1997 | E21B/17/01 |

OTHER PUBLICATIONS

1998–99 Cameron Catalog; selected pages; Mar. 1998; (17 p.).

*Through–Flowline (TFL) Equipment*; Otis; (undated) (p. 240).

Winton, Jack; *Use of Multi–Lateral Wells to Access Marginal Reservoirs*, Offshore; Feb. 1999; (3 p.).

Jee, T., et al; *The Use of Screwed Flowlines in Deepwater*, DOT Conference 1993; Nov. 18, 1993; (16 p.).

* cited by examiner

*Primary Examiner*—Heather Shackelford
*Assistant Examiner*—John Kreck
(74) *Attorney, Agent, or Firm*—Conley Rose, P.C.

(57) ABSTRACT

An underwater well system in which an initially vertical drilling riser conduit is fixed by a template at the seabed in a non-vertical orientation. Drilling is carried out through wellhead in the template which also includes a valve tree allowing the production fluid to be brought to the surface along a line separate from the drilling riser conduit. The template may be a junction template allowing several wells to be drilled from a single template, or allowing the template to be connected by one or more drilling conduits to further templates such that a wide area of the seabed can be covered for a single drilling riser conduit.

19 Claims, 12 Drawing Sheets

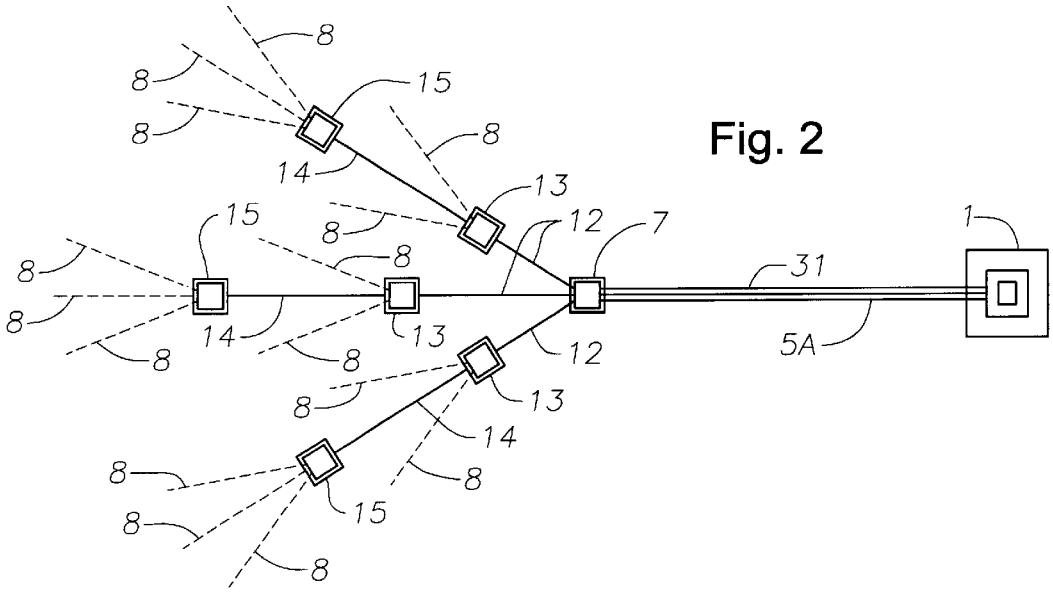
Fig. 2
Fig. 3
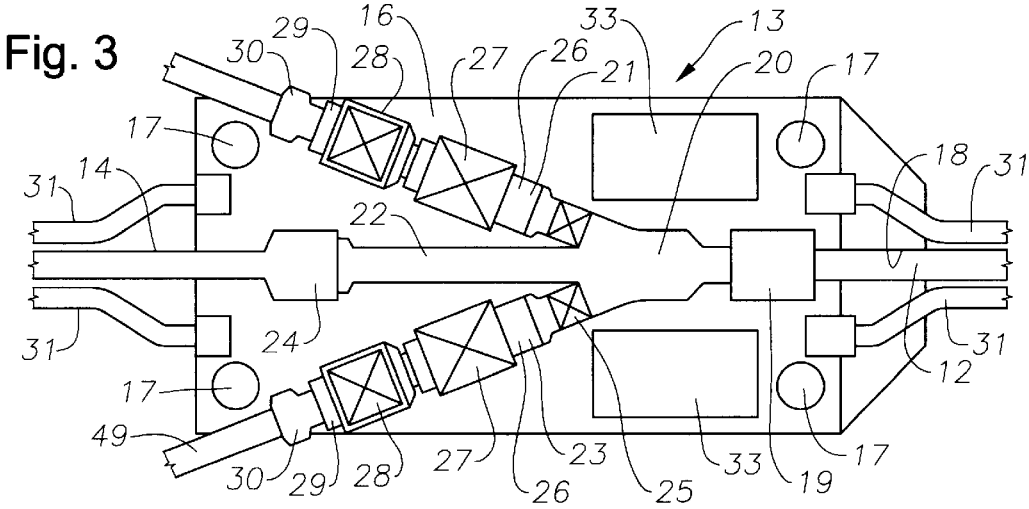

METHOD FOR DRILLING A PLURALITY OF OFFSHORE UNDERWATER WELLS

CROSS-REFERENCE TO RELATED APPLICATIONS

This application is a divisional application based on U.S. patent application Ser. No. 09/275,748, filed Mar. 24, 1999 now U.S. Pat. No. 6,497,286.

BACKGROUND OF THE INVENTION

The present invention relates to a method and apparatus for drilling a plurality of wells.

Two conventional methods exist for drilling an offshore underwater well. The first of these is to drill and set a conductor pipe between a surface platform and the sea bed followed by drilling a surface well using a platform wellhead. The Blow Out Preventer (BOP) is located on the surface wellhead. Subsequent casing strings are landed in the surface wellhead. The well is completed by suspending completion tubing from the wellhead and installing a platform tree. A second method is to drill and set a conductor pipe into the seabed using a floating drilling vessel with the wellhead located on the bed. A subsea drilling BOP has to be run on a drilling riser down to the seabed and is connected to the subsea wellhead. A subsea well is drilled with casing hangers landed in the subsea wellhead followed by the tubing completion the well is completed by placing a tree on the seabed wellhead. An alternative subsea option is to use a horizontal tree and then run the tubing.

As the industry moves further offshore and beyond the continental shelf, the water depths being considered are drastically increasing as reservoirs down the flank of the continental shelf and on the ocean floors are discovered. These water depths rule out the use of conventional platforms and their low cost drilling techniques. Floating or tension production platform systems can be used but their drilling footprint into the reservoir is limited, requiring peripheral seabed subsea production support wells. Subsea fields involve considerable complex subsea architecture and require extensive high cost rig intervention.

One way in which an attempt has been made to increase the footprint of a production platform is the provision of a slanted conductor. In such an arrangement, the conductor is supported at an angle by the platform so that it can be run in at an angle thereby increasing the lateral distance between the base of the platform and the location where the conductor meets the seabed. However, such an arrangement is awkward and costly as it requires a specially made structure to support the conductor at an angle. Further, the system will not work in deep water without some support for the conductor at various locations between the surface and the seabed which is not available from a floating platform.

Our co-pending application (Agent's Ref: PAJ07074EP), corresponding to U.S. patent application Ser. No. 09/275,346, filed Mar. 24, 1999 entitled "Method and Apparatus for Drilling an Offshore Underwater Well," filed on the same day as the present application discloses a method of drilling an offshore underwater well comprises the steps of installing a riser conduit so that it is substantially vertically supported at a production deck situated substantially at the sea surface and deviates progressively further from the vertical with increasing sea depth, fixing the riser conduit at the seabed in a non-vertical orientation, and drilling the well into the seabed at an angle to the vertical.

As the riser conduit is substantially vertically supported at the production deck, it is possible to use conventional platform drilling and production techniques which help keep the drilling costs to a minimum. Further, because the riser conduit is supported at the surface and at the seabed, and deviates progressively further from the vertical in between, intermediate support is not required but can be provided if necessary by buoyancy modules.

In some fields, the reservoir could be relatively close to the seabed. In such a case, there is insufficient depth for a conventional subsea well which starts vertically at the seabed to be deviated to a sufficient angle to access reservoir formations not already being drained by nearby vertical or deviated wells. Therefore only a limited reservoir acreage can be accessed. With this arrangement some of this deviation from the vertical is already provided before reaching the seabed, so that less deviation is required underground which allows higher angle or horizontal wells to be drilled far along the reservoir. This allows better access to reservoirs which are close to the seabed. However, the most important benefit of this arrangement arises when the water is sufficiently deep that the riser conduit can be deviated to be horizontal at the seabed. Once the riser conduit becomes horizontal, it is possible to extend it some considerable distance along the seabed before drilling into the seabed so that the drilling footprint of a platform can be greatly increased without drilling.

SUMMARY OF THE INVENTION

The present invention relates to an improvement of the method and apparatus of our co-pending application.

Although the system of the co-pending application represents a vast improvement on the prior art in terms of being able to increase the size of the footprint of a platform, it does require the riser conductor to be able to contain the full production pressure and over riser conductor per well.

According to the present invention a method of drilling and completing an underwater well comprises the steps of installing a drilling riser conduit which is vertical at the sea surface to the seabed with the lower end of the drilling riser conduit connected to a template having an inlet port to which the lower end of the drilling riser conduit is connected and a wellhead accessed through the inlet port, such that the drilling riser conduit is at an angle to the vertical at the seabed; fixing the template to the seabed; drilling into the seabed through the wellhead in the template at an angle to the vertical; landing and sealing the well casing and a completion string within the wellhead; and installing a valve tree in the template to direct the flow of production fluid to the surface along a line separate from the drilling riser conduit.

As the wellhead is now at the seabed and the production fluid flows to the surface through a line separate from the drilling riser conduit, it is no longer necessary to have a wellhead at the platform, nor is it necessary for the drilling riser conduit to be lined to take the full reservoir pressure.

There is also preferably provided within the template means for receiving a BOP for installation during well drilling and completing.

A method of landing and locating various components, such as the valve tree and/or the BOP is to lower the components on a skid into the template, and then extend connecting elements together to seal inlet and outlet ports of the components in place.

The well casing is preferably centred in the wellhead by radially projecting centring members.

A further drawback with the system of the co-pending application is that it requires one riser conduit per well. This can be a problem for a large reservoir as each riser conductor requires one well slot on the platform. The hanging loads caused by the casing strings and the heavy mud columns will require high deck support from a large tension leg platform when a large number of wells are being drilled and completed. In addition the drilling range with this concept is limited to the maximum drilling reach from a single point. A large field would now require several platform systems or revert back to using a subsea field system for distant wells.

One major benefit of the present invention arises when several wells can be drilled from a single template. In this case, the template is a junction template provided with a plurality of outlet ports each associated with its own wellhead and valve tree, and a port selector is provided for selectively connecting the inlet port with any one of the outlet ports, the method further comprising drilling into the seabed selectively through more than one outlet port using the port selector selectively to provide access to each outlet port.

This method allows a plurality of wells to be drilled from a single drilling riser conduit.

The step of drilling through the outlet port may either be done directly into the seabed, or may be indirectly done when the above junction template is a first stage junction template through one or more second stage junction templates, each having an inlet port, a plurality of outlet ports, and a port selector for selectively connecting the inlet port with any one of the outlet ports, at least one of the outlet ports of the first stage junction template being connected by a drilling conduit to the inlet port of a second stage junction template. It is possible for the second stage junction templates to be connected in a similar way to one or more third stage junction templates each having an inlet port, a plurality of outlet ports, and a port selector for selectively connecting the inlet port with any one of the outlet ports, such that a branched configuration comprising numerous wells can be constructed in order to cover a large area of a reservoir using only a single drilling riser conduit. Additional stages of junction templates can be added if necessary.

With the method of the present invention, it will often be the case that pipes have to be run down the drilling riser conduits and drilling conduits to the well templates on a running tool. The pipes will have to pass along significant lengths of horizontal drilling riser conduit. According to a further aspect of the present invention, there is provided a method of propelling a running tool and associated piping along a horizontal section of conduit, the running tool being provided with at least one piston element between the piping and a drilling installation, the outer diameter of the piston being substantially equal to the inner diameter of the conduit, so that the running tool slides through the drilling riser conduit and a piston seals with the drilling riser conduit; the method comprising the step of introducing hydraulic fluid into the drilling riser conduit behind of the piston member in order to push the piston member and hence the running tool along the conduit.

Preferably, several pistons are provided in series to distribute the load over all of the pistons and to ensure that they maintain a propulsive force on the running tool even if the seal of an individual piston loses its integrity.

Preferably a utility line extends from the drilling installation to meet the internal bore of the drilling conduit at a location beyond of the most advanced location of the piston closest to the running tool, and at least one valve is provided to control fluid flow through the utility line. This utility line can be used to accommodate fluid displaced by the pistons when the running tool is run in, and also can be used to provide hydraulic pressure on the downstream side of the or each piston so as to assist with a withdrawal of the running tool.

The template forms an independent aspect of the present invention which can be broadly defined as a template for a subsea wellhead assembly the template comprising a main body, means for fixing the main body to the seabed, an inlet port for receiving a drilling riser conduit at an angle to the vertical, a wellhead inclined at an angle to the vertical, and being accessible through the inlet port, and means for receiving other wellhead components such as a valve tree and BOP aligned such that they can be accessed through the inlet and allow access to the wellhead.

The orientation of the inlet port and wellhead is preferably such that, when the template is fixed to the seabed, the inlet port and wellhead are substantially horizontal.

The template is preferably provided with at least one bay for receiving various well components such as the valve tree and/or BOP, each component being mounted on a skid, and being extendable to locate and seal in the template.

In the case of the junction template, there is preferably further included a plurality of outlet ports, and a port selector for selectively communicating the inlet port with each of the plurality of outlet ports.

The template may be in two parts, one housing the wellhead and other wellhead components, the other housing the port selector. This helps reduce the size of individual components.

The orientation of the inlet and outlet ports and the means for anchoring the main body is preferably such that, when the junction template is fixed to the seabed, the ports open substantially horizontally.

The convenient method of fixing the junction template to the seabed has been found to be by using a gravity base or piles.

According to a further aspect of the present invention there is provided an apparatus for drilling a plurality of underwater wells, the apparatus comprising a drilling riser conduit extending from the sea surface to the seabed, such that the drilling riser conduit is at an angle to the vertical at the seabed, a junction template as defined above anchored to the seabed, wherein the drilling riser conduit is connected to the inlet port of the junction template, and wherein a plurality of drilling conduits extend across the seabed, and/or a plurality of conductor pipes extend into the seabed, from the outlet ports of the junction template.

When a drilling conduit extends from an outlet port, it is connected to the inlet port of a second stage junction template as defined above. The second stage junction template may also have both drilling conduits and conductor pipes extending from its outlets with one or more further stages of junction templates according to the second aspect of the present invention being connected in a similar way to each drilling conduit.

If the production fluid is to flow to the surface through the drilling riser conduit, it is necessary to provide a pressure containing casing type within the drilling riser conduit. However, the preferred alternative is to provide in the well template for each branch at which a well is drilled a subsea valve tree which is preferably a horizontal valve tree. Thus, the flow from each well can be brought to the surface externally of the drilling riser conduit in a conventional flow line.

BREIF DESCRIPTION OF THE DRAWINGS

Examples of a method and apparatus in accordance with the present invention will now be described with reference to the accompanying drawings, in which:

FIG. 2 is a diagrammatic plan of a field layout;

FIG. 3 is a schematic plan of a first or second stage template with a drilling conduit;

DESCRIPTION OF THE PREFERRED EMBODIMENTS

Figure 1:
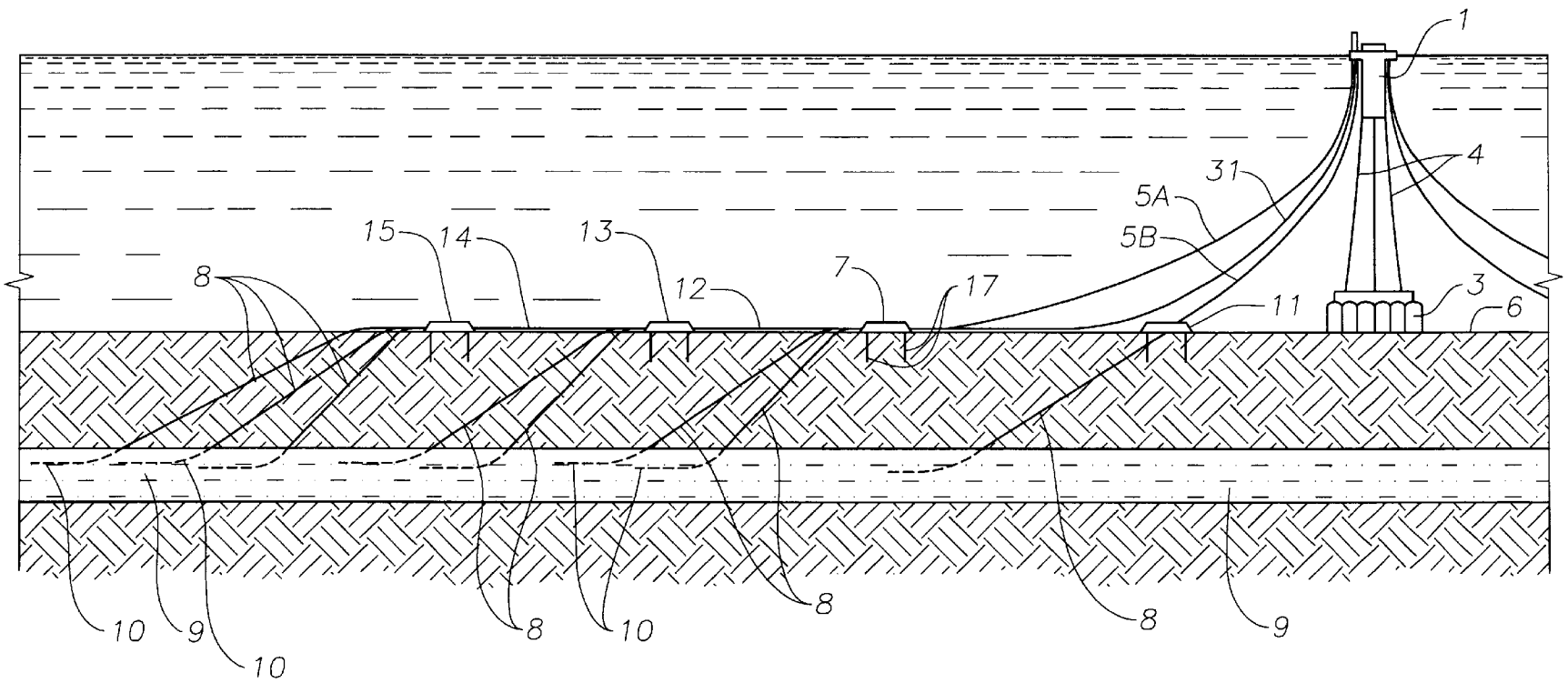
FIG. 1 is a schematic view of a field assembly according to the first example.

FIG. 1 shows an example of a tension leg production installation 1 which is shown at the sea surface and is anchored to an optional gravity storage base 3 by mooring legs 4. From the production installation a number of drilling riser conduits 5A, 5B are suspended initially vertically, but deviating progressively from the vertical with increasing sea depth. The conduit 5A has sufficient curvature that by the time it reaches the seabed 6, it is horizontal and can extend a significant horizontal distance along the seabed. At the desired location, the conduit 5A terminates at a first stage junction template 7 from which a pair of cased wells 8 extend towards the production reservoir 9, with each well terminating at a liner or screen 10.

A conduit 5B is of similar construction, with the one exception that it is not horizontal at the seabed. Instead, it is fastened as an oblique angle to a skid 11 and the cased well 8 extends at the same angle into the seabed 6. See FIG. 9C showing the wellhead at an oblique angle to the seabed 6.

In addition to the two wells 8 which extend from the output parts of the first stage junction template 7, a drilling conduit 12 extends from a further output part across the seabed 6 to a second stage drilling template 13. The second stage drilling template 13 has the same construction as the first stage drilling template 7, in that up to two wells 8 extend into the production formation and a drilling conduit 14 extends across the seabed to a third stage junction template 15. As this could be the last stage template, it is of slightly different construction in that three wells 8 extend from this template 15 into the formation 9.

An alternative layout of junction templates is shown in plan in FIG. 2. In this case, instead of any wells being formed at the first stage junction template 7, three drilling conduits 12 extend to respective second stage junction templates 13. These second stage junction templates 13 have the same construction as the second stage junction templates of FIG. 1 in that two wells 8 and one drilling conduit 14 extend from each second stage junction template. This allows for three third stage junction templates 15 which are again constructed in the same way as the third stage junction templates 15 in FIG. 1, each having three wells 8 extending to the formation 9.

To further extend the range of the system, a well template can be used joined by a drilling conduit to a junction template. The well template would contain the wellhead, tree bay and BOP bay, and respective production/drilling pipework.

It is readily apparent from a combination of FIGS. 1 and 2 how a very large area of reservoir can be covered from a single production installation 1.

Figure 3A:
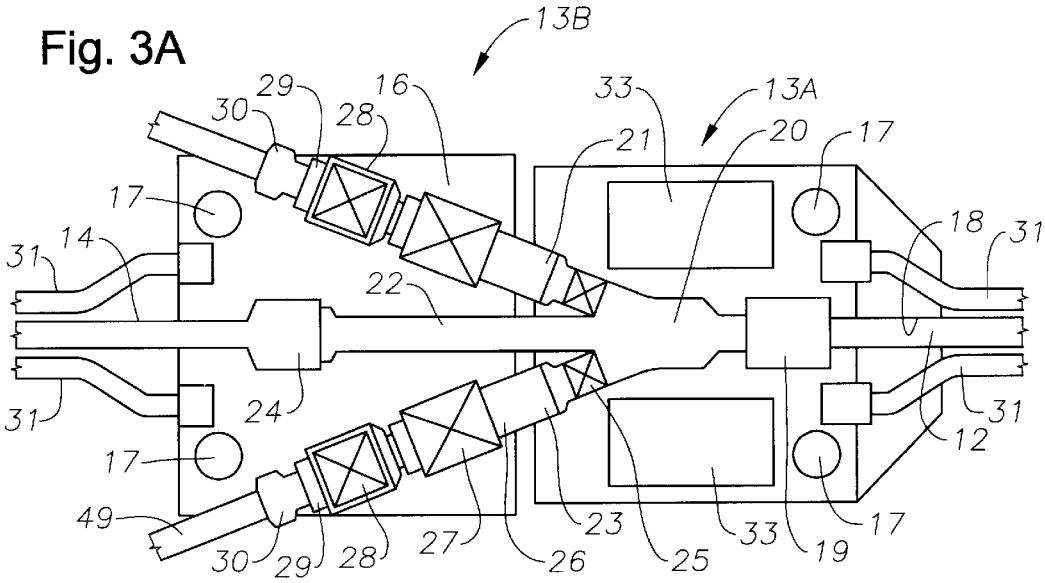
FIG. 3A is a schematic plan of a first or second stage template in two parts and with a drilling conduit.
Figure 4:
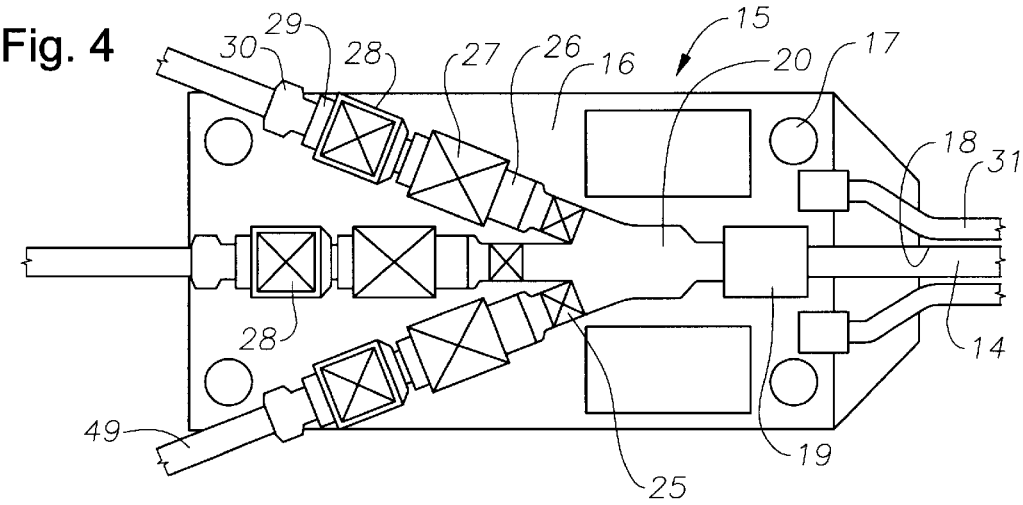
FIG. 4 is a schematic plan of an end stage template.

Details of the junction templates will now be described with reference to FIGS. 3 and 4, in which FIG. 3 shows a second stage junction template 13 and FIG. 4 shows a third or end stage junction template 15. Each junction template 15 consists of a main body 16 having four piles 17, one in each corner, for securing the junction template to the seabed 6. An inlet port 18 receives a drilling conduit 12, 14. The inlet port leads to a swivel telescopic unit 19 which, during installation, is fixed in mid-stroke, and is released once the installation is complete to allow for twist and thermal expansion of the drilling conduit. Connected immediately to the swivel telescopic unit 19 is a junction joint 20 which may be of any known suitable construction for selectively communicating the inlet 12 with any one of three branches 21, 22, 23. Two examples of suitable junction joints are given in FIGS. 5 and 6A and 6B as described below.

Figure 5:
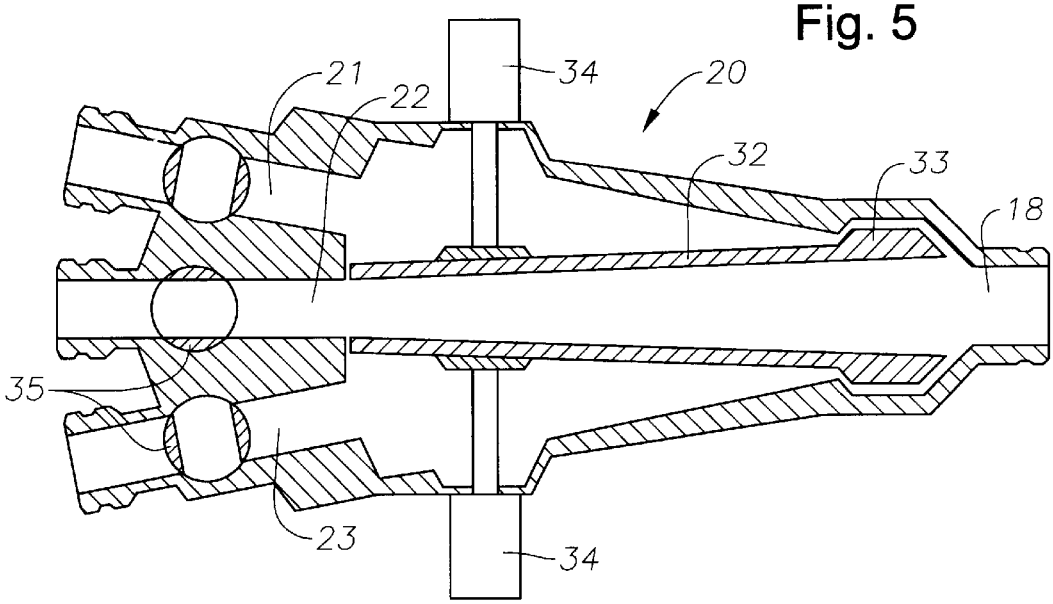
FIG. 5 is a schematic view of a first example of a junction joint.

According to a first example of a junction joint shown in FIG. 5, a permanent junction sleeve 32 is positioned in the template so as to be pivotable about an end 33 adjacent to the inlet port 18. The sleeve 32 is movable by means of a pair of mechanical or hydraulic sleeve actuation units 34 which can move the sleeve 32 so as to align the inlet port 18 with any one of the three branches 21, 22, 23. Each branch is provided with an isolation unit 35 so as to allow any branch, such as branches 21, 23 which are not being used to be closed and sealed, while opening the branch 22 to be drilled.

Figure 6A:
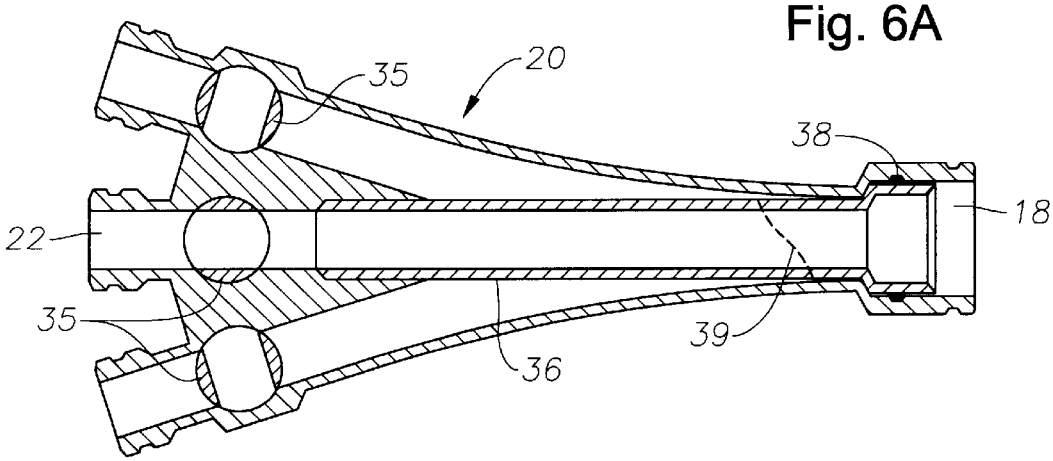
FIGS. 6A and 6B are schematic drawings of a second example of a junction joint.
Figure 6B:
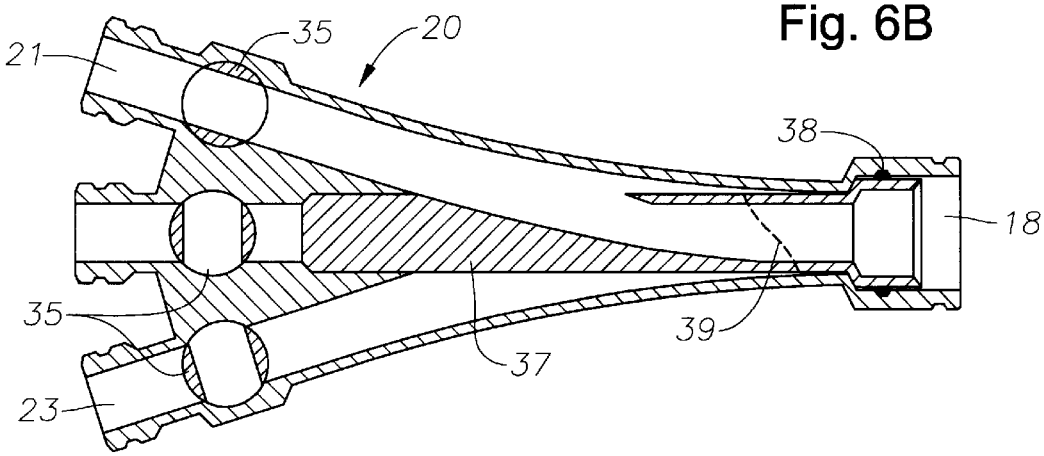

In the alternative arrangement shown in FIG. 6A and FIG. 6B, the permanent junction sleeve 32 shown in FIG. 5 is replaced by one of several junction sleeves such as straight junction sleeve 36 and deviated junction sleeve 37 depending upon the branch to which access is required. Thus, the straight junction sleeve 36 provides access to the central bore 22, while the deviated sleeve 37 provides access to the branch 21. A deviated sleeve having a mirror image to that shown in FIG. 6B can be used to provide access to the branch 23. The appropriate sleeve is run into the template and is locked by means of locks 38 adjacent to the inlet port 18. A helix 89 provided on the sleeve engages with a helix in the template to ensure that the sleeve 36, 37 is correctly orientated. When access to a different branch is required, the sleeve 36, 37 is pulled and a sleeve 36, 37 of different configuration is run in. As with the previous example, the fluid isolation units 35 are provided to close the branches 21, 22, 23 which are not in use.

The structure of the template junction below the junction joint depends upon whether the outlet port 18 is used for a well 8, or a drilling conduit 12, 14. In the case of the second stage junction template 13 shown in FIG. 3, the central branch 22 provides a connection 85 to a drilling conduit 14, while the two outermost branches 21, 23 are provided for wells 8. For the first junction template 7 shown in FIG. 2, it will be appreciated that all three branches 21, 22, 23 will be the same as the central branch 22 in FIG. 3 to allow for the connection of three drilling conduits, while in FIG. 4, all branches 21, 22, 23 are the same as the outermost branches 21, 23 of FIG. 3 to allow three wells to be drilled.

Each branch to which a drilling conduit 12, 14 is connected is simply provided with a drilling conduit pulling and connection unit 24 to which the drilling conduit 12, 14 is connected.

Each branch from which a well is drilled comprises in a direction extending away from the junction joint branch 23 a fluid isolation unit 25, a telescopic connector 26, a horizontal BOP 27, a horizontal spool tree body 28, a wellhead connector 29 and a horizontal wellhead 30.

Although the wellhead elements are shown on the same template as the junction joint, it may be preferable to provide the wellhead elements on a template separate from the junction joint to prevent the template from becoming too large and unwieldy. See FIG. 3A showing two part templates 13A and 13B.

Several of these elements in the vertical mode are well known in the art.

Figure 7:
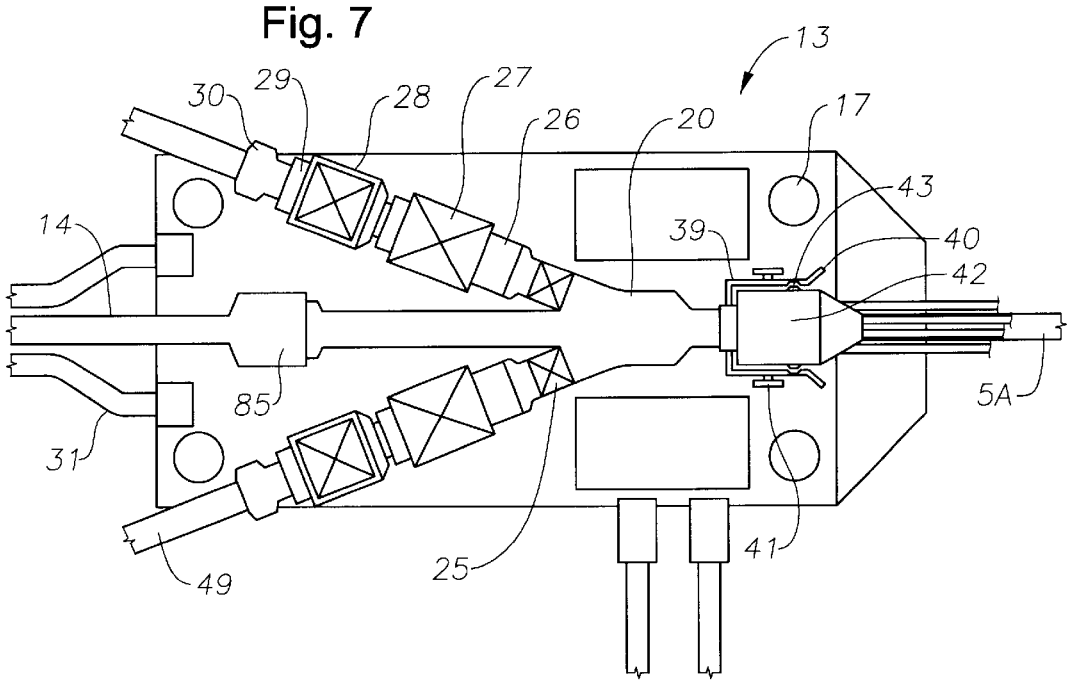
FIG. 7 is a view similar to FIG. 3 showing the template with a drilling riser conduit.

In order to install the system, because the junction templates 7, 13, 15 are too big to be run in from the platform, the template junctions are towed or lifted into place. Initially, the three central template junctions 7, 13, 15 shown in FIG. 2 attached by drilling conduits 12, 14 can be towed into place and are fixed to the seabed 6. Alternatively for distant wells, the templates are provided with a socket 39 for receiving the drilling riser conduit 5A as shown in FIG. 7. The socket 39 comprises a funnel 40 pivotally connected about a horizontal axis by a pivot structure 41. A drilling riser end package 42 at the end of the drilling riser conduit 5A is stabbed into the funnel 40 where it is locked in place by a locking means 43. The funnel 40 can then be pivoted about the horizontal axis so that the package is substantially horizontal at the seabed, and the drilling riser conduit 5A is secured to the respective bores and parts. The drilling riser conduit 5A is then brought up to the production installation 1.

At this stage, either the wells 8 from the central junction templates 7, 13, 15 can be drilled selectively using the junction joint 20 of each template to select the appropriate branch, or the additional junction templates of the lateral branches 21, 22, 23 as shown in FIG. 2 can be towed into place, fixed to the seabed, and connect to the outlets of the first stage template junction 7 by drilling conduits 12.

A detailed description of the drilling and completion of a typical well will now be given with reference to FIGS. 8 to 14B.

Figure 8:
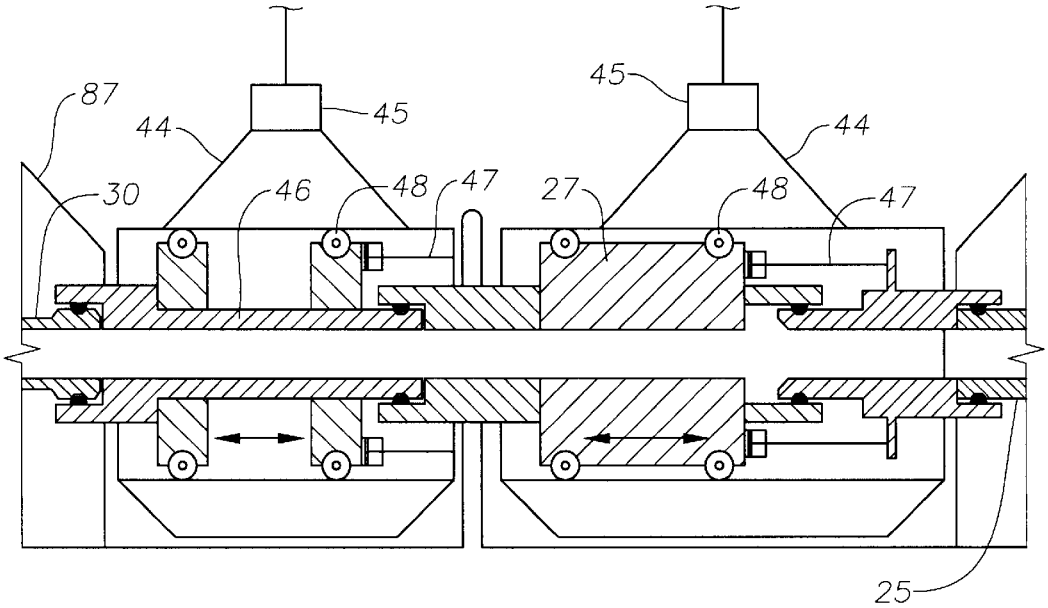
FIG. 8 is a schematic of the initial arrangement in the template between a fluid isolation unit and the wellhead.

FIG. 8 shows the initial arrangement within the template between a fluid isolation unit 25 which would be provided immediately to the right of the arrangement shown in FIG. 8 and the wellhead 30 shown at the left of FIG. 8. A pair of guidelineless skids 44 are landed in appropriate bays 87 in the template. Each skid 44 is lowered, using a lift line connected to a running hub 45 at the top of the skid 44. The right hand skid contains a BOP 27, while the left hand skid contains a bridging sleeve 46. Both the BOP 27 and bridging sleeve 46 are provided with a hydraulic system of double acting pistons 47, and rollers 48 which allow them to be telescopically extended into the engaged and sealed position shown in FIG. 8. When engaged the functional lines, i.e. kill, choke, utility and controls 31 are in line connected.

Figure 9A:
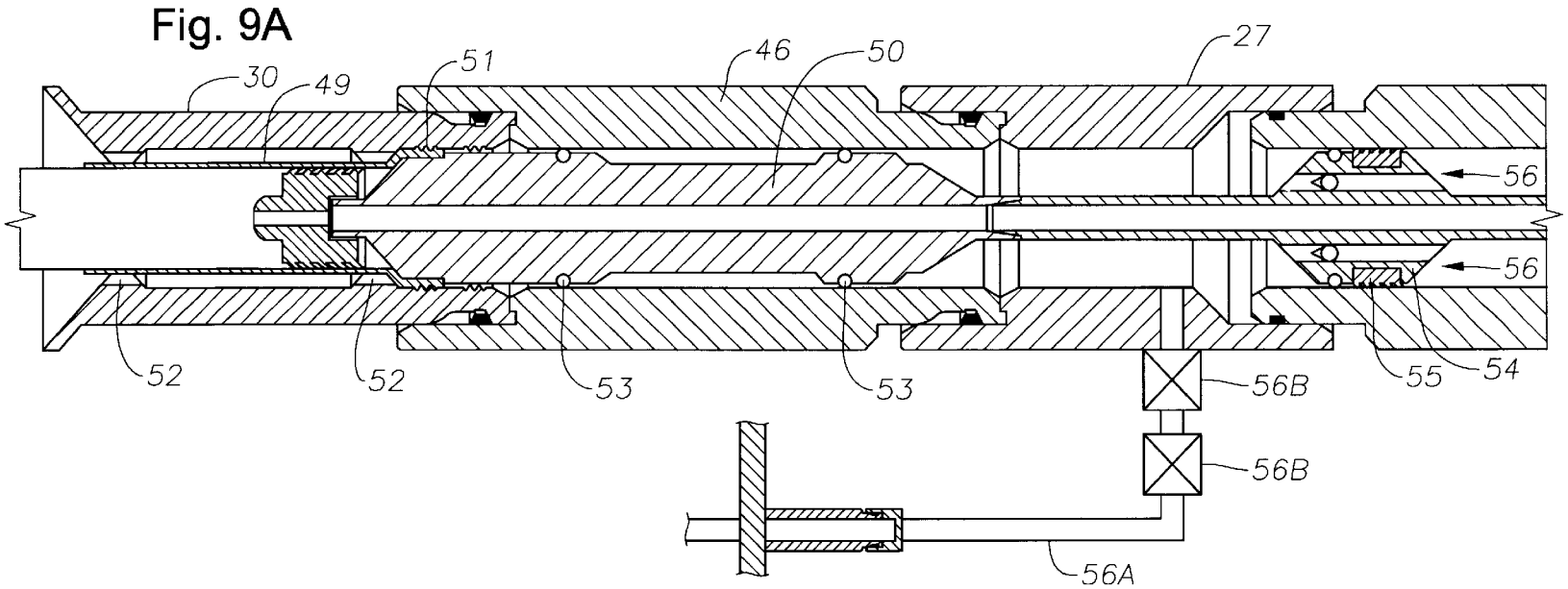
FIG. 9A is a schematic of a conductor being landed within the wellhead.

With the BOP 27 and bridging sleeve 26 in place, a conductor 49, as shown in FIG. 9, is landed within the wellhead 30 on a running tool 50 and is latched and sealed in place by latches 51. The process is similar to the process for landing a conductor in a conventional vertical wellhead except that it is necessary to ensure that the running tool 50 and conductor 49 are centralised. To this end, radially inwardly extending guides 52 are provided within the wellhead 30 to align the conductor 49 in the wellhead 30. Also, guidance bearings 53 align the running tool 50 within the bridging sleeve 46 to ensure it is in line and centralised.

Figure 9B:
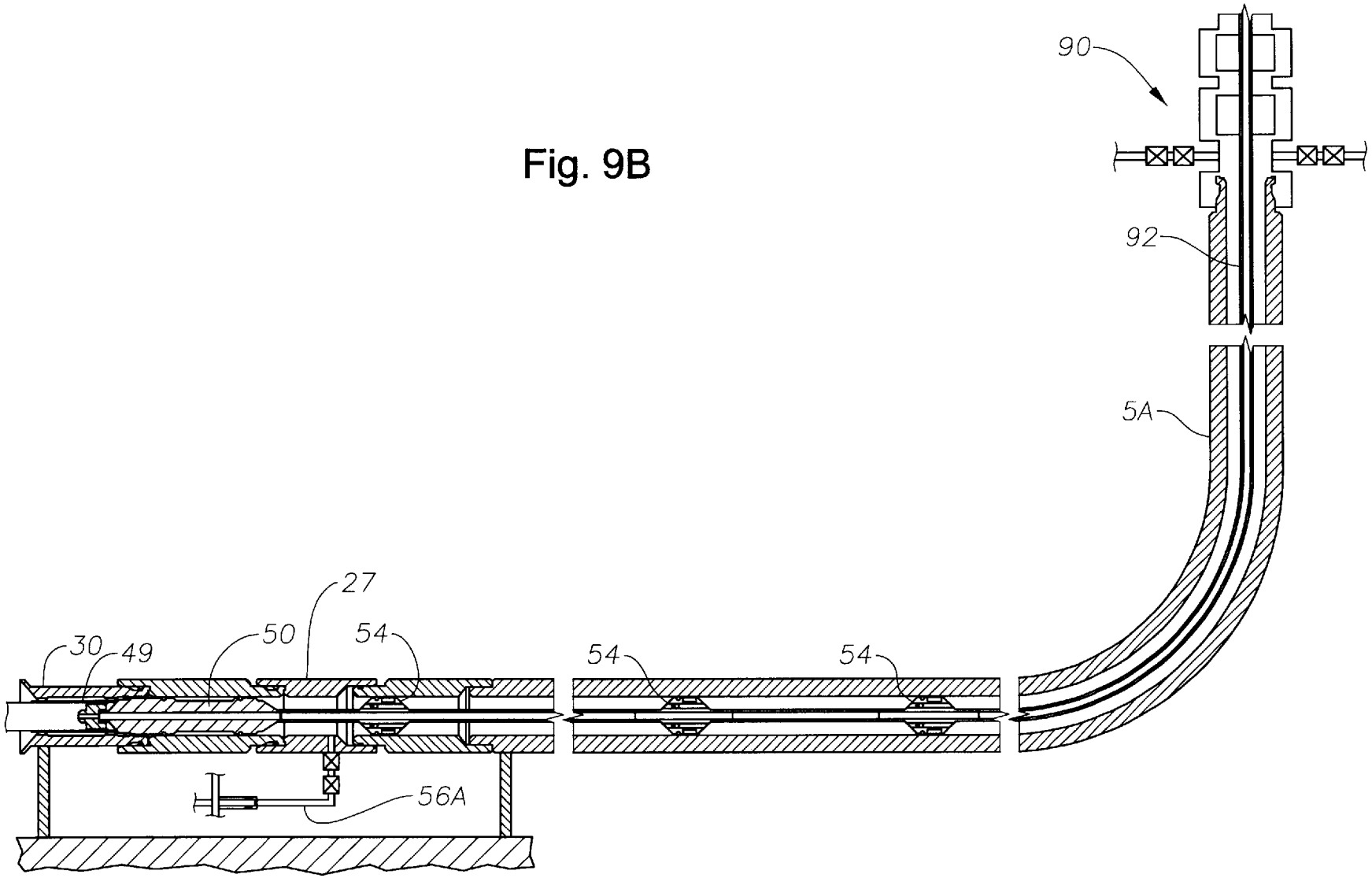
FIG. 9B is an expanded schematic of the step depicted in FIG. 9A.
Figure 9C:
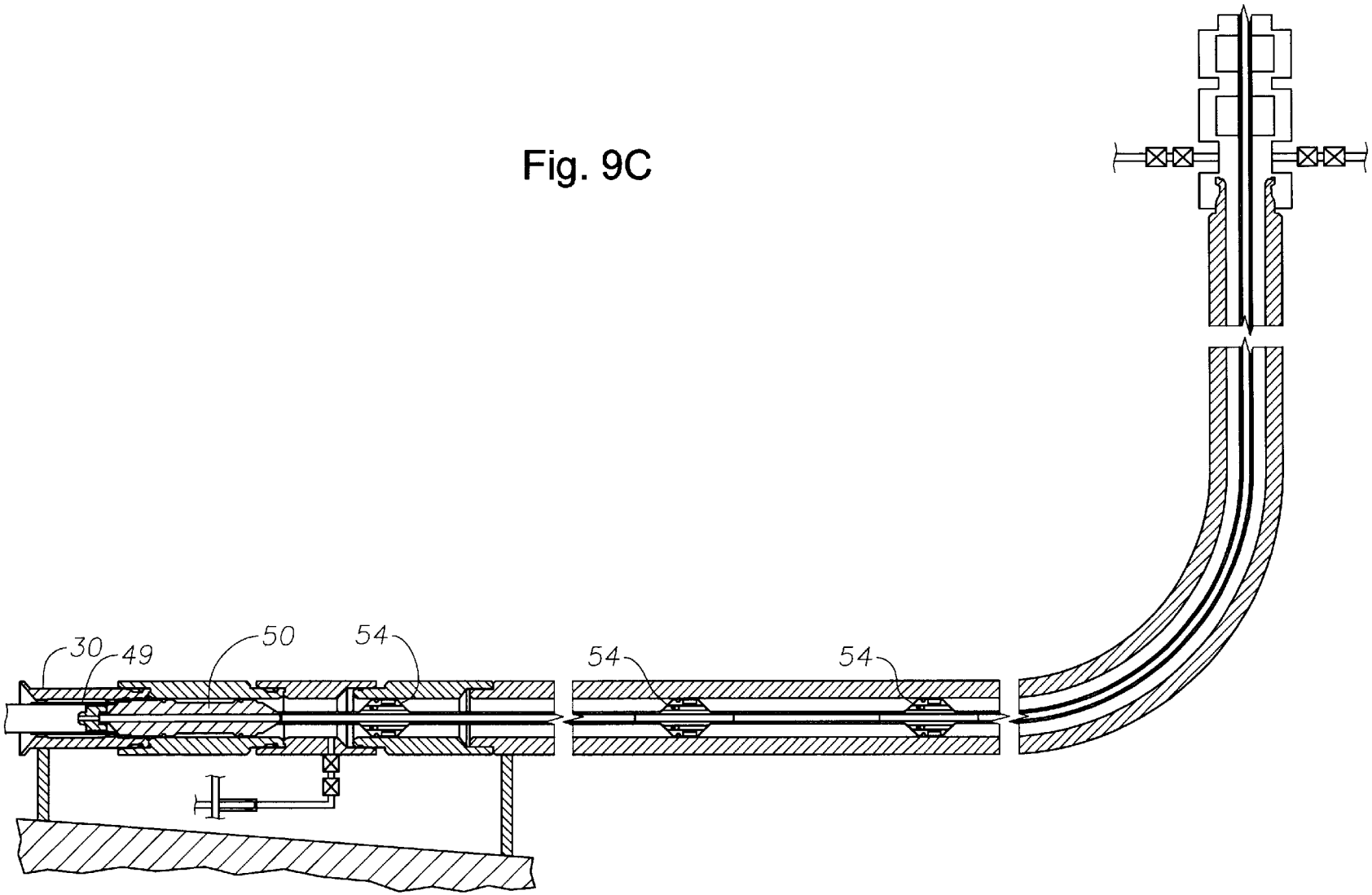
FIG. 9C is an expanded schematic of the step depicted in FIG. 9A.

In order to propel the running tool 50 along horizontal sections of the drilling riser conduit 5A, the running tool 50 is provided with a piston 54 having a seal 55 which allows the running tool to be propelled by hydraulic pressure applied to the piston member 54 in the direction of arrows 56. It may be useful to have several pistons 54 connected in series to distribute the forces as shown in FIG. 9B and to ensure that the running tool 50 is always moved, even if a seal 55 of one piston member 54 loses its integrity. The or each piston 54 is provided with a plurality of check valves 84 which allow the running tool to be run without hydraulic pressure. Alternatively, the check valves 84 are differential valves, which allow each piston 54 to vent once a certain differential is reached. This allows the hydraulic pressure to be shared between the various pistons 54. For example, for a total hydraulic pressure of 1500 psi, the check valves 56B can be arranged so that 300 psi is applied to each of five pistons 54.

A return fluid path is provided by a utility line 56A flow through which is controlled by a pair of valves 56B. The utility line 56A is provided back to the drilling installation 90 to provide a means of circulating the drilling riser conduit 5A. When running casing, returns from the well fluids being driven in front of the piston 54 can be returned to the surface. The utility line 56A will also take the displaced fluids from the well while cementing the casing strings.

When pulling out of the drilling riser conduit 5A with the running string 92, the utility line 56A will be used to pressure assist the running string out and to ensure the well/drilling riser conduit 5A is maintained at a set pressure.

Figure 10:
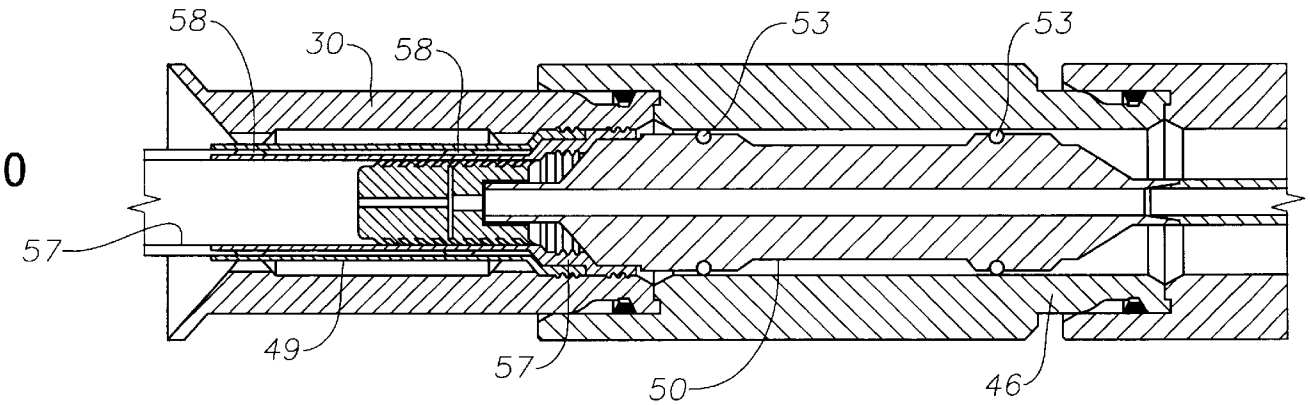
FIG. 10 is a schematic of the wellhead once an intermediate casing has been placed.

With the conductor 49 in place, an intermediate casing 57 is landed, cemented using conventional techniques, locked and sealed in a similar manner as shown in FIG. 10. Again, the installation of intermediate casing 57 is generally similar to a conventional vertical installation, but the intermediate casing 57 is provided with radially outwardly extending guide members 58 to ensure that it is centralised within the conductor 49.

Figure 11:
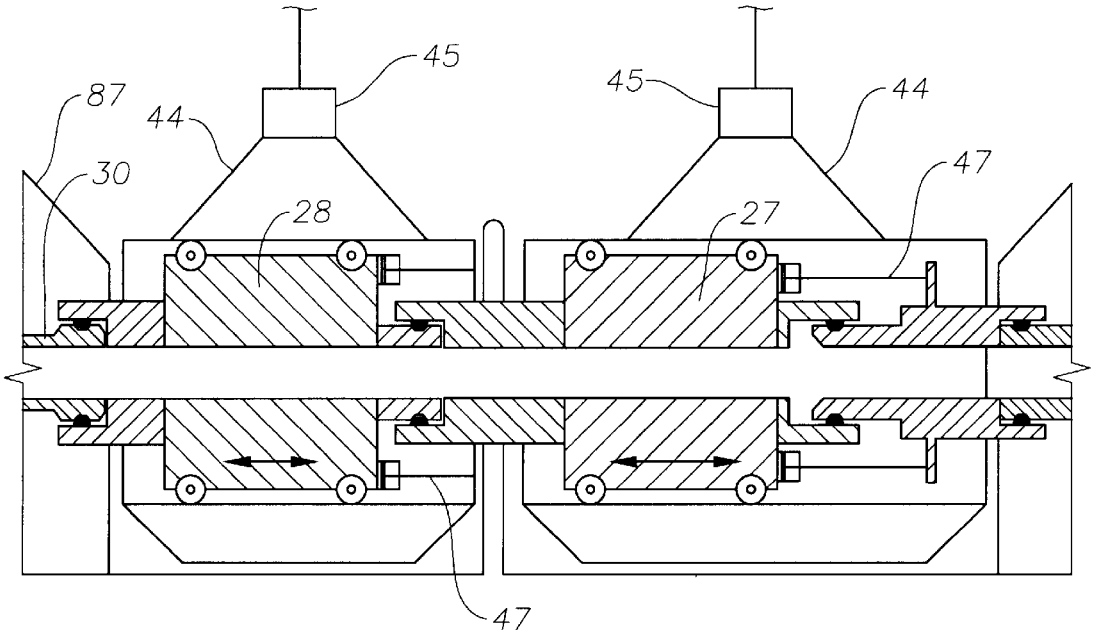
FIG. 11 is schematic of the telescoping wellhead equipment with a horizontal tree and a BOP installed.

The BOP 27 is telescopically retracted, the bridging sleeve 46 is withdrawn and removed on its guidelineless skid 44, and is replaced by a horizontal spool tree 28 on a similar guidelineless skid 44. The tree functions are in line connected, i.e. the production and annulus flow lines. The BOP 27 is telescopically re-engaged so that the system locks and seals between the wellhead 30 and the fluid isolation unit 25 as shown in FIG. 11.

Figure 12:
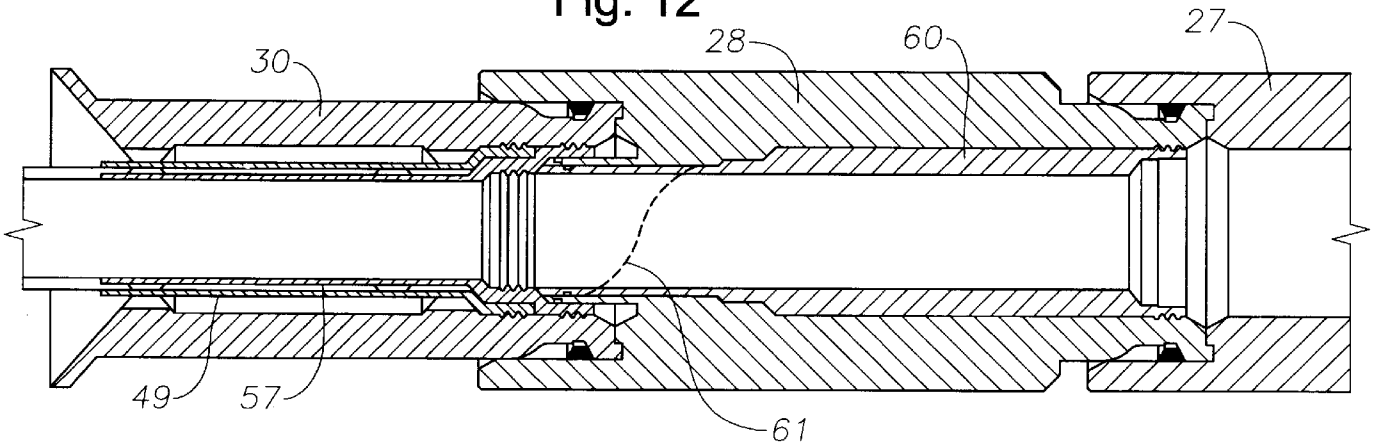
FIG. 12 is schematic of a pressure containing bore protecting sleeve oriented in the tree.

A pressure containing bore protecting sleeve 60 is placed within the tree and is correctly oriented by means of a helix 61 as shown in FIG. 12. Drilling can now take place through the sleeve 60 and intermediate casing 57.

Figure 13:
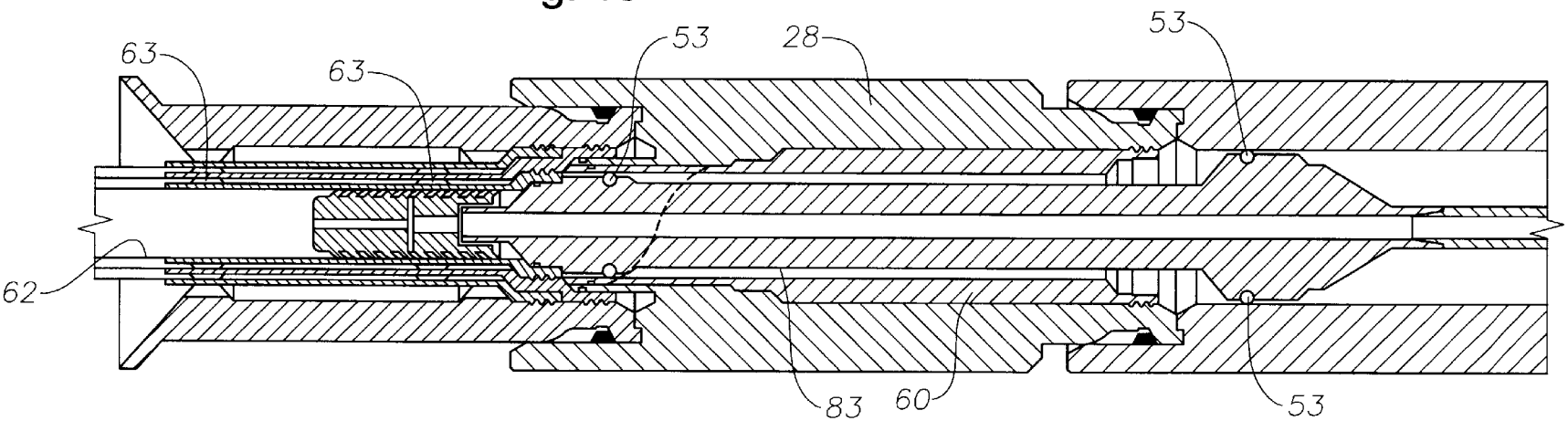
FIG. 13 is a schematic shows a production casing string landed within the wellhead.
Figure 14B:
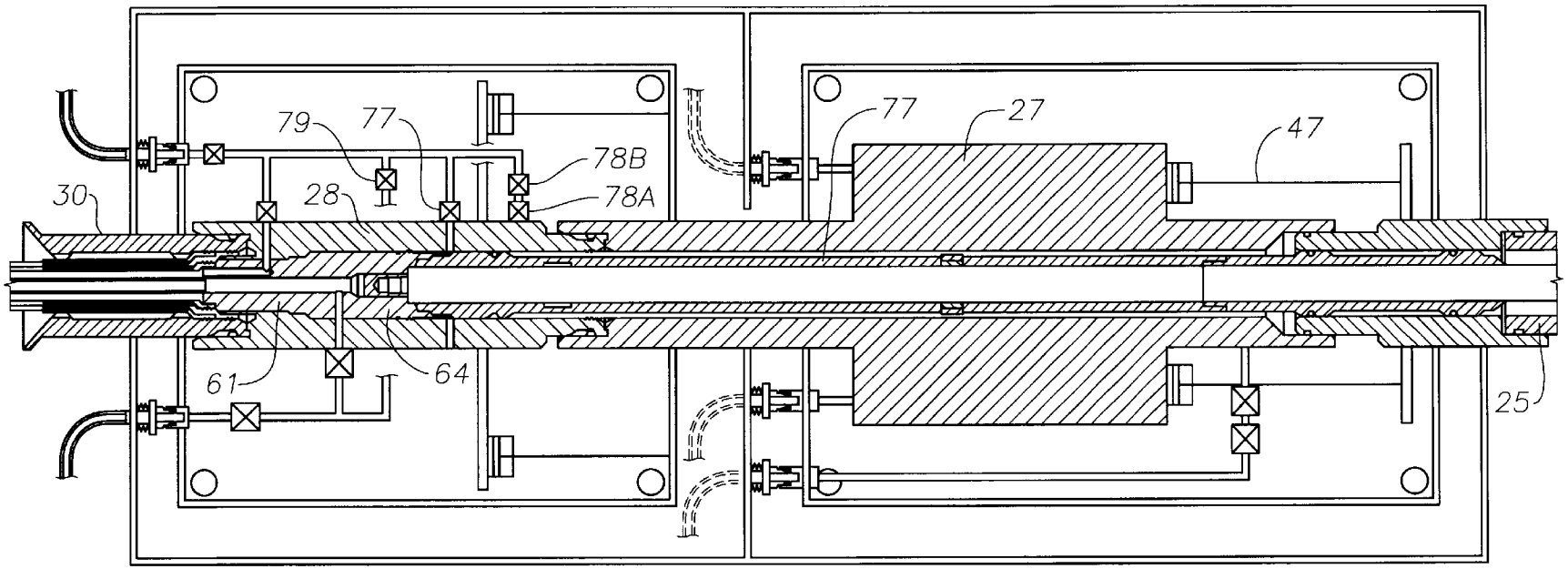
FIG. 14B is a schematic that shows the lateral production bore of the tree aligned with the lateral bore of the tubing hanger.

As shown in FIG. 13, the production casing string 62 is then landed within the wellhead 30 and cemented using conventional techniques. The production casing string 62 is centralised by radially extending guides 63 on a controlled running tool 83.

Further drilling is required into reservoir 9 for the liner or screens 10. These are cemented or sealed off using conventional downhole techniques.

Figure 14A:
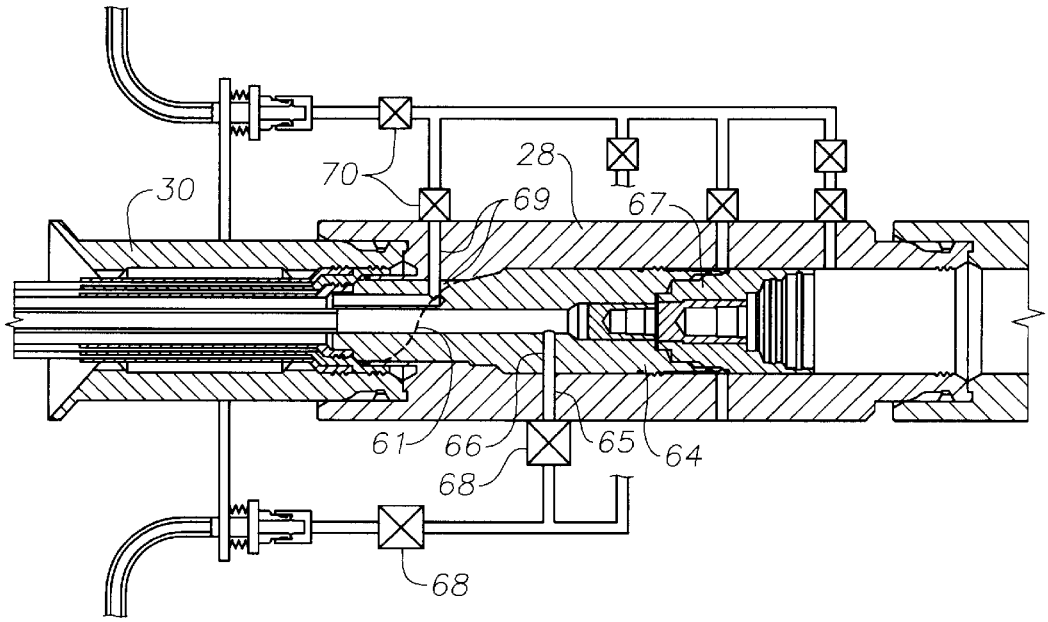
FIG. 14A is a schematic of a tubing hanger and subsea test tree installed on the tree.

The bore protecting sleeve 60 is then retrieved and a tubing hanger 64 is run on a subsea test tree 77 into the tree 28 and correctly oriented by the helix 61 as shown in FIG. 14A. The lateral production bore 65 within the tree 28 is aligned with a lateral bore 66 in the tubing hanger 64 as shown in FIG. 14A. The main bore of the tubing hanger 64 is plugged with a bore plug 64A followed by a tree body plug 67 which contains its own bore plug 67A. The well is now ready for production. Production fluid flows out of the tree 28 through lateral bores 65,66 under the control of two valves 68. Access to the annulus is provided through lateral bores 69 and means for well monitoring are provided in the usual way. A spool tree crossover valve, workover valve 87 and a inner and outer tree circulation valves 78A and 78B, are provided.

The BOP is only required while the well is being drilled and completed. Once these operations are completed, the BOP can be removed and replaced with a telescopic pipe unit. The BOP can then be used for the completion of the next well.

It will be appreciated from this that the drilling casing for each well extends back only as far as the horizontal wellhead 30 and that the production fluid is routed through the horizontal spool tree body 28. Thus, any of the wells 8 can be drilled and put into production while other of the wells 8 are being drilled. This allows the system to be installed in a phased manner allowing extra branches to be brought into production as the field evolves or is determined. It is also possible to intervene in any drilled well at any time without disturbing other drilled wells.

Figure 15:
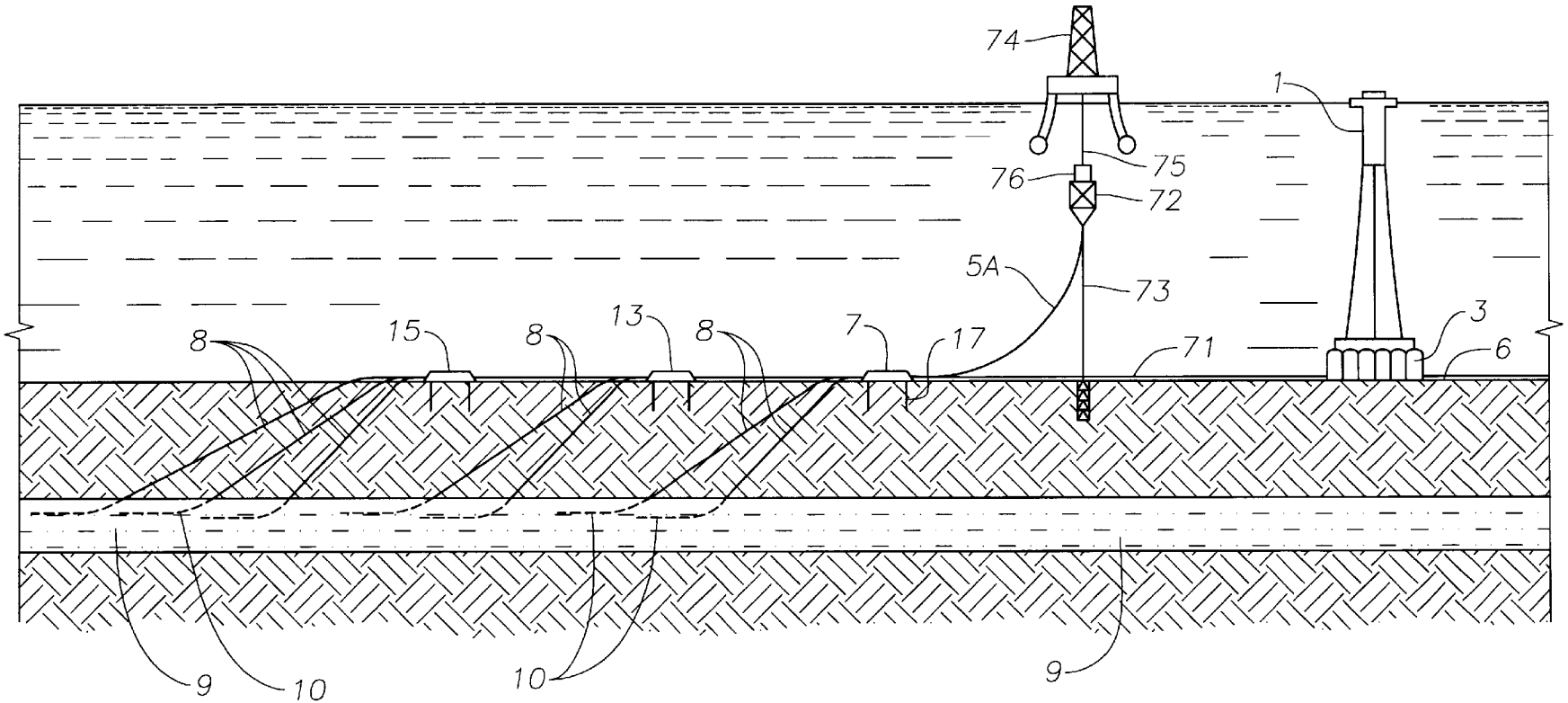
FIG. 15 is a schematic view of a second field example using a free standing drilling riser conduit.

An alternative configuration is shown in FIG. 15. This is similar in most respects to the arrangement shown in FIG. 1. The difference lies in the fact that the drilling riser conduit 5A is run from a floatation unit with a riser isolation unit 72 which is anchored to the seabed via tension line 73. The floatation unit with riser isolation unit 72 is connected to a mobile drilling vessel 74 by a short drilling riser 75. The production fluid flow lines 71, run along the seabed to the storage base 3 of the tension leg production installation or other suitable production installation which could be a low cost tanker system as it does not have to support any risers. This arrangement allows the well system to be situated much further from the tension leg production installation. Also, a shallow water disconnect mechanism 76 is provided on the flotation unit with riser isolation unit 72 to allow the mobile drilling vessel 74 to be disconnected without pulling the drilling riser conduit 5A.

What is claimed is:

1. A method of drilling and completing an underwater well, the method comprising the steps of:

installing a drilling riser conduit from a surface installation to the seabed;

connecting the drilling riser conduit to an inlet port disposed on a template that is fixed to the seabed, wherein the inlet port is at an angle to the vertical;

passing a second conduit through drilling riser conduit, the inlet port, and into a wellhead disposed on the template, wherein the wellhead is at an angle to the vertical;

drilling into the seabed through the wellhead at an angle to the vertical using the second conduit;

landing and sealing a well casing and a completion string within the wellhead; and installing a valve tree in the template to direct the flow of production fluid to the surface along a line separate from the drilling riser conduit, wherein the valve tree is installed without removing the drilling riser conduit from the inlet port.

2. A method according to claim 1, wherein there is also provided within the template means for receiving a BOP for installation during well drilling and completing.

3. A method according to claim 2, wherein various components are installed within the template by lowering a component on a skid into the template, and then extending connecting elements together to seal inlet and outlet ports of the components in place.

4. A method according to claim 2, wherein the well casing is centered in the wellhead by radially projecting centering members.

5. A method according to claim 2, using a template from which several wells can be drilled from the seabed, wherein in the template is a junction template provided with a plurality of outlet ports each associated with its own wellhead and valve tree, and a port selector for selectively connecting the inlet port with any one of the outlet ports, the method further comprising drilling into the seabed selectively through more than one outlet port using the port selector selectively to provide access to each outlet port.

6. A method according to claim 1, wherein various components are installed within the template by lowering a component on a skid into the template, and then extending connecting elements together to seal inlet and outlet ports of the components in place.

7. A method according to claim 6, wherein the well casing is centered in the wellhead by radially projecting centering members.

8. A method according to claim 6, using a template from which several wells can be drilled from the seabed, wherein in the template is a junction template provided with a plurality of outlet ports each associated with its own wellhead and valve tree, and a port selector for selectively connecting the inlet port with any one of the outlet ports, the method further comprising drilling into the seabed selectively through more than one outlet port using the port selector selectively to provide access to each outlet port.

9. A method according to claim 1, wherein the well casing is centered in the wellhead by radially projecting centering members.

10. A method according to claim 9, using a template from which several wells can be drilled from the seabed, wherein in the template is a junction template provided with a plurality of outlet ports each associated with its own wellhead and valve tree, and a port selector for selectively connecting the inlet port with any one of the outlet ports, the method further comprising drilling into the seabed selectively through more than one outlet port using the port selector selectively to provide access to each outlet port.

11. A method according to claim 1, using a template from which several wells can be drilled from the seabed, wherein in the template is a junction template provided with a plurality of outlet ports each associated with its own wellhead and valve tree, and a port selector for selectively connecting the inlet port with any one of the outlet ports, the method further comprising drilling into the seabed selectively through more than one outlet port using the port selector selectively to provide access to each outlet port.

12. A method according to claim 11, wherein the junction template is a first stage junction template and drilling is done indirectly through one or more second stage junction templates, each having an inlet port, a plurality of outlet ports, and a port selector for selectively connecting the inlet port with any one of the outlet ports, at least one of the outlet ports of the first stage junction template being connected by a drilling conduit to the inlet port of a second stage junction template.

13. A method according to claim 12, wherein the second stage junction templates are connected in a similar way to one or more third stage junction templates each having an inlet port, a plurality of outlet ports, and a port selector for selectively connecting the inlet port with any one of the outlet ports.

14. A method for drilling and completing a subsea well from a surface platform comprising:

fixing a template to the seabed, wherein the template has an inlet port and a wellhead inclined at an angle to the vertical;

extending a riser conduit from the surface platform to the inlet port, wherein the riser conduit is substantially vertical the surface platform and inclined at an angle to the vertical at the inlet port;

passing a second conduit through the riser conduit and the wellhead into the seabed, wherein the second conduit is adapted to be propelled through the riser conduit by applying hydraulic pressure to a piston connected to the second conduit and sealingly engaging the riser conduit;

drilling a well into the seabed using the second conduit, wherein drilling fluids are not returned to the surface through the riser conduit;

landing and setting a well casing into the well, wherein the well casing is passed through the riser conduit and set in sealing engagement with the wellhead;

setting a completion string into the well; and producing the well.

15. The method of claim 14 further comprising disposing a wellhead component in the template such that the wellhead component can be accessed by the second conduit and allow access to the wellhead.

16. A method for drilling and completing a subsea well from a surface platform comprising:

fixing a template to the seabed, wherein the template has an inlet port and a wellhead inclined at an angle to the vertical;

extending a riser conduit from the surface platform to the inlet port, wherein the riser conduit is substantially vertical the surface platform and inclined at an angle to the vertical at the inlet port;

passing a second conduit through the riser conduit and the wellhead into the seabed;

drilling a well into the seabed using the second conduit, wherein drilling fluids are not returned to the surface through the riser conduit;

landing and setting a well casing into the well, wherein the well casing is passed through the riser conduit and set in sealing engagement with the wellhead;

setting a completion string into the well; and producing the well; wherein the inlet port and wellhead are substantially horizontal.

17. A method for drilling a plurality of subsea wells from a surface platform comprising:

fixing on the seabed a template having an inlet port and a plurality of outlet ports, wherein the inlet port and outlet ports are at an angle to the vertical;

attaching a riser conduit from a substantially vertical position at the surface platform to the inlet port, wherein the riser conduit is in a position inclined at an angle to the vertical at the inlet port;

using a port selector for selectively communicating one of the plurality of outlet ports with the inlet port;

passing a second conduit through the riser conduit and through the inlet port and the selected outlet port;

drilling a well into the seabed using the second conduit.

18. The method of claim 17 further comprising:

providing a plurality of wellheads in communication with individual ones of the plurality of outlet ports; and providing a plurality of drilling conduits extending into the seabed at and angle to the vertical from individual ones of the plurality of wellheads.

19. The method of claim 17 further comprising providing a third conduit adapted to carry fluids from the template to the surface platform.

* * * * *